US012747875B2

(12) United States Patent
Spalding

(10) Patent No.: US 12,747,875 B2
(45) Date of Patent: Sep. 29, 2026

(54) PORTABLE MISTING COOLER APPARATUS AND SYSTEM

(71) Applicant: JS2 Enterprises, LLC, Easley, SC (US)

(72) Inventor: Justin Spalding, Easley, SC (US)

(73) Assignee: JS2 Enterprises, LLC, Easley, SC (US)

( * ) Notice: Subject to any disclaimer, the term of this patent is extended or adjusted under 35 U.S.C. 154(b) by 227 days.

(21) Appl. No.: 18/652,440

(22) Filed: May 1, 2024

(65) Prior Publication Data

US 2024/0369243 A1 Nov. 7, 2024

Related U.S. Application Data

(60) Provisional application No. 63/463,239, filed on May 1, 2023.

(51) Int. Cl.
*F24F 13/20* (2006.01)
*F24F 5/00* (2006.01)

(52) U.S. Cl.
CPC ..... *F24F 5/0035* (2013.01); *F24F 13/20* (2013.01); *F24F 2221/12* (2013.01)

(58) Field of Classification Search
CPC ... F24F 5/0035; F24F 2221/12; B05B 9/0861; B05B 9/0888; B05B 7/2475; B05B 7/02; B05B 5/1691; B05B 15/65
See application file for complete search history.

(56) References Cited

U.S. PATENT DOCUMENTS

| | | | |
|---|---|---|---|
| 4,697,740 | A | 10/1987 | Ivy |
| 4,815,665 | A | 3/1989 | Haruch |
| 4,839,106 | A | 6/1989 | Steiner |
| 5,338,495 | A | 8/1994 | Steiner et al. |
| 6,182,463 | B1 | 2/2001 | Strussion et al. |
| 6,212,897 | B1 | 4/2001 | Wang |
| 6,471,194 | B2 | 10/2002 | Keeney |
| 6,578,828 | B2 | 6/2003 | Terrell et al. |
| 6,786,701 | B1 | 9/2004 | Huang et al. |
| 7,100,906 | B2 | 9/2006 | Kucera |
| 7,137,269 | B1 | 11/2006 | Maranville |
| 7,150,162 | B1 | 12/2006 | Brunner |
| 7,210,637 | B1 | 5/2007 | Johnson |
| 7,527,246 | B2 | 5/2009 | Chang |
| 7,806,388 | B2 | 10/2010 | Junkel et al. |
| 7,871,022 | B1 | 1/2011 | Plyler |
| 8,016,270 | B2 | 9/2011 | Chen et al. |

(Continued)

FOREIGN PATENT DOCUMENTS

JP 3122136 U 6/2006

*Primary Examiner* — Christopher R Dandridge
(74) *Attorney, Agent, or Firm* — Gregory Finch; Finch Paolino, LLC

(57) ABSTRACT

An exemplary system, method, and apparatus according to the principles herein include a misting cooler apparatus and system comprising a battery, misting tubing with nozzles, hook and loop straps, and clips to mount the misting tubing. In accordance with certain aspects of the present disclosure, the misting nozzles can be attached to chairs, tents, umbrellas, trees and/or other outdoor structures. The misting cooler contains a water reservoir configured to supply water to the misting nozzles. The cooler can also be used to store ice and cold drinks.

20 Claims, 10 Drawing Sheets

(56) References Cited

U.S. PATENT DOCUMENTS

| | | | | |
|---|---|---|---|---|
| 8,056,834 | B2 | 11/2011 | Gardner et al. | |
| 8,056,837 | B2 | 11/2011 | Gardner et al. | |
| 8,205,806 | B2 | 6/2012 | Mak et al. | |
| 8,662,413 | B2 * | 3/2014 | Rotondo | F24F 6/14 285/133.11 |
| 8,783,663 | B2 | 7/2014 | Fitton et al. | |
| 8,794,599 | B2 | 8/2014 | Steiner | |
| 9,056,325 | B2 | 6/2015 | Torontow | |
| 9,199,106 | B2 | 12/2015 | Lowry | |
| 9,267,698 | B2 | 2/2016 | Stearns | |
| 9,339,827 | B2 | 5/2016 | Chan | |
| 9,752,790 | B2 | 9/2017 | McDonnell | |
| 10,527,301 | B2 | 1/2020 | Schock | |
| 10,603,680 | B2 | 3/2020 | Laikind | |
| 2013/0098079 | A1 | 4/2013 | Apolony et al. | |
| 2013/0175714 | A1 | 7/2013 | Altman et al. | |
| 2015/0367365 | A1 * | 12/2015 | Burks | B05B 9/0861 239/154 |
| 2017/0173607 | A1 * | 6/2017 | Wright | B05B 9/0861 |
| 2018/0266714 | A1 | 9/2018 | Perrelle | |
| 2019/0001354 | A1 * | 1/2019 | Laikind | A61F 7/00 |

* cited by examiner

PORTABLE MISTING COOLER APPARATUS AND SYSTEM

CROSS-REFERENCE TO RELATED APPLICATIONS

The present application claims the benefit of and priority to U.S. provisional patent application Ser. No. 63/463,239, entitled "PORTABLE MISTING COOLER APPARATUS AND SYSTEM" and having a filing date of May 1, 2023; the contents of which being incorporated herein in their entirety at least by virtue of this reference.

FIELD

The present disclosure relates to the field of personal cooling systems; in particular, a portable misting cooler apparatus and system.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a portable misting system comprising an insulated cooler portion configured to retain a volume of water, the insulated cooler portion comprising an aperture disposed on a bottom surface of the insulated cooler portion and configured to pass a volume of water therethrough; a base assembly comprising an upper surface configured to be selectively interfaced with the bottom surface of the insulated cooler portion, wherein the base assembly comprises a water inlet comprising a fitting configured to interface with the aperture of the insulated cooler portion to receive the volume of water; a pump housed in an interior portion of the base assembly; a first water tube configured to transfer the volume of water from the water inlet to the pump; a second water tube configured to transfer the volume of water from the pump to a water outlet disposed on a surface of the base assembly; a hose selectively coupled to the water outlet and configured to receive the volume of water via the water outlet; at least one misting nozzle coupled to an end of the hose, the at least one misting nozzle configured to output a mist of water; and a rechargeable battery housed in the interior portion of the base assembly and configured to provide a flow of power to the pump.

Further aspects of the present disclosure provide for a portable misting system comprising an insulated cooler portion configured to retain a volume of water, the insulated cooler portion comprising an aperture disposed on a bottom surface of the insulated cooler portion and configured to receive a flow of water therethrough; a base assembly comprising an upper surface configured to interface with the bottom surface of the insulated cooler portion, wherein the base assembly comprises a water inlet configured to interface with the aperture of the insulated cooler portion to receive the flow of water therethrough; a pump housed in an interior portion of the base assembly; a first water line configured to transfer the flow of water from the water inlet to the pump; and a second water line configured to transfer the flow of water from the pump to a water outlet disposed on an exterior surface of the base assembly.

In accordance with certain embodiments, the portable misting system may further comprise a first hose segment selectively coupled to the water outlet and configured to receive the flow of water via the water outlet. In said embodiments, the portable misting system may further comprise at least one first misting nozzle coupled to a portion of the first hose segment, the at least one first misting nozzle configured to output a mist of water. In said embodiments, the portable misting system may further comprise a second hose segment selectively coupled to the first hose segment, wherein the second hose segment is configured to receive the flow of water via the first hose segment. In said embodiments, the portable misting system may further comprise at least one second misting nozzle coupled to a portion of the second hose segment, the at least one second misting nozzle configured to output the mist of water. In accordance with certain aspects of the present disclosure, the portable misting system may further comprise at least one battery housed in the interior portion of the base assembly, the at least one battery being configured to provide a flow of power to the pump. In certain embodiments, the insulated cooler portion may be configured to be selectively removable from the base assembly. In certain embodiments, the portable misting system may further comprise a controller operably engaged with the pump, wherein the controller is configured to control at least one operation of the pump.

Still further aspects of the present disclosure provide for a portable misting apparatus comprising an insulated cooler portion comprising a bottom surface, side walls, and a top configured to define an internal area, the internal area being configured to retain a volume of water therein, wherein the bottom surface of the insulated cooler portion comprises an aperture configured to receive a flow of water therethrough; and a base assembly comprising a rigid housing, the rigid housing comprising an upper surface and an interior area, wherein the base assembly comprises a water inlet disposed on the upper surface of the rigid housing and a water outlet disposed on a first surface of the rigid housing, wherein the bottom surface of the insulated cooler portion is interfaced with the upper surface of the rigid housing such that the water inlet is interfaced with the aperture of the insulated cooler portion to receive the flow of water therethrough, wherein the base assembly comprises a pump housed in the interior area of the rigid housing, wherein the pump is operably configured to receive the flow of water from the water inlet and output a pressurized flow of water to the water outlet.

In accordance with certain aspects of the present disclosure, the water outlet may be configured to be selectively interfaced with at least one misting hose. In certain embodiments, the insulated cooler portion may be configured to be selectively removable from the base assembly. In certain embodiments, the portable misting apparatus may further comprise at least one battery housed in the interior area of the rigid housing, the at least one battery being configured to provide a flow of power to the pump. In certain embodiments, the portable misting apparatus may further comprise a controller operably engaged with the pump, wherein the controller is configured to control at least one operation of the pump. In said embodiments, the portable misting apparatus may further comprise a user interface disposed on a second surface of the rigid housing, wherein the user interface is operably engaged with the controller and configured to command one or more operations of the controller in response to a user input.

Still further aspects of the present disclosure provide for a portable misting system comprising an insulated cooler portion comprising an interior area configured to retain a volume of water therein, a bottom surface, and an aperture disposed on the bottom surface configured to pass a flow of water therethrough; a base assembly comprising a rigid housing comprising an upper surface, a water inlet disposed on the upper surface of the rigid housing, a pump housed in an internal area of the rigid housing, and a water outlet disposed on a surface of the rigid housing, wherein the bottom surface of the insulated cooler portion is interfaced with the upper surface of the rigid housing such that the aperture disposed on the bottom surface is interfaced with the water inlet to pass the flow of water therethrough, wherein the pump is operably configured to receive the flow of water from the water inlet and output a pressurized flow of water to the water outlet; and at least one hose segment selectively coupled to the water outlet, the at least one hose segment comprising at least one misting nozzle, wherein the at least one hose segment is configured to receive the pressurized flow of water via the water outlet and output a mist of water via the at least one misting nozzle.

In accordance with certain aspects of the present disclosure, the portable misting system may further comprise at least one battery housed in the internal area of the rigid housing, the at least one battery being configured to provide a flow of power to the pump. In said embodiments, the portable misting system may further comprise at least one battery removable from the internal area of the rigid housing. In certain embodiments, the portable misting system may further comprise a controller operably engaged with the pump, wherein the controller is configured to control at least one operation of the pump. In said embodiments, the portable misting system may further comprise a user interface operably engaged with the controller and configured to command one or more operations of the controller in response to a user input. In accordance with certain embodiments, the base assembly of the portable system is configured to provide structural support for the insulated cooler portion.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

Figure 1:
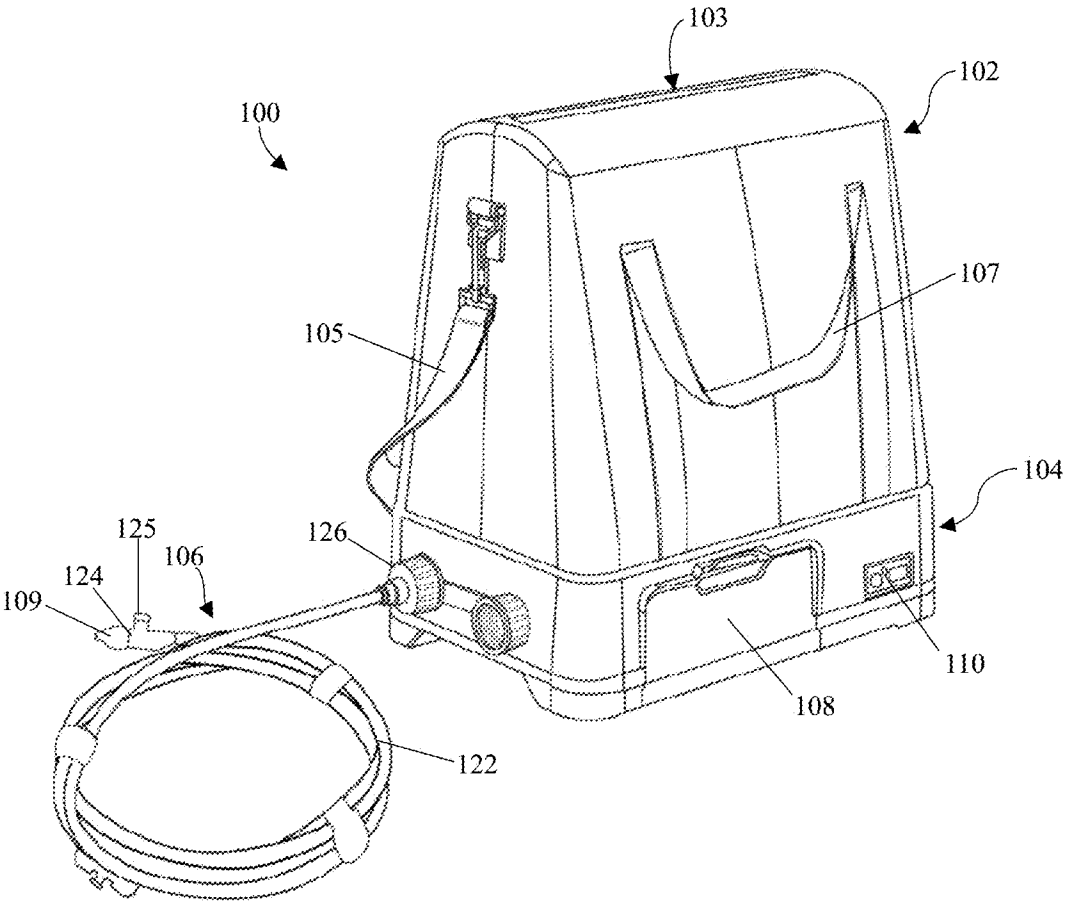
FIG. 1 is an isometric view of a portable misting cooler apparatus and system, in accordance with certain aspects of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout. All definitions, as defined and used herein, should be understood to control over dictionary definitions, definitions in documents incorporated by reference, and/or ordinary meanings of the defined terms.

Following below are more detailed descriptions of various concepts related to, and embodiments of, inventive methods, devices and systems configured to provide for a portable misting cooler apparatus and system. In accordance with certain aspects of the present disclosure, a portable misting system may comprise an insulated cooler portion configured to retain a volume of water, the insulated cooler portion comprising an aperture disposed on a bottom surface of the insulated cooler portion and configured to pass a volume of water therethrough; a base assembly comprising an upper surface configured to be selectively interfaced with the bottom surface of the insulated cooler portion, wherein the base assembly comprises a water inlet comprising a fitting configured to interface with the aperture of the insulated cooler portion to receive the volume of water; a pump housed in an interior portion of the base assembly; a first water tube configured to transfer the volume of water from the water inlet to the pump; a second water tube configured to transfer the volume of water from the pump to a water outlet disposed on a surface of the base assembly; a hose selectively coupled to the water outlet and configured to receive the volume of water via the water outlet; at least one misting nozzle coupled to an end of the hose, the at least one misting nozzle configured to output a mist of water; and a rechargeable battery housed in the interior portion of the base assembly and configured to provide a flow of power to the pump. In accordance with certain aspects of the present disclosure, a portable misting cooler apparatus may comprise an insulated cooler portion comprising a bottom surface, side walls, and a top configured to define an internal area, the internal area being configured to retain a volume of water therein, wherein the bottom surface of the insulated cooler portion comprises an aperture configured to receive a flow of water therethrough; and a base assembly comprising a rigid housing, the rigid housing comprising an upper surface and an interior area, wherein the base assembly comprises a water inlet disposed on the upper surface of the rigid housing and a water outlet disposed on a first surface of the rigid housing, wherein the bottom surface of the insulated cooler portion is interfaced with the upper surface of the rigid housing such that the water inlet is interfaced with the aperture of the insulated cooler portion to receive the flow of water therethrough, wherein the base assembly comprises a pump housed in the interior area of the rigid housing, wherein the pump is operably configured to receive the flow of water from the water inlet and output a pressurized flow of water to the water outlet. In accordance with certain aspects of the present disclosure, a portable misting system may comprise an insulated cooler portion comprising an interior area configured to retain a volume of water therein, a bottom surface, and an aperture disposed on the bottom surface configured to pass a flow of water therethrough; a base assembly comprising a rigid housing comprising an upper surface, a water inlet disposed on the upper surface of the rigid housing, a pump housed in an internal area of the rigid housing, and a water outlet disposed on a surface of the rigid housing, wherein the bottom surface of the insulated cooler portion is interfaced with the upper surface of the rigid housing such that the aperture disposed on the bottom surface is interfaced with the water inlet to pass the flow of water therethrough, wherein the pump is operably configured to receive the flow of water from the water inlet and output a pressurized flow of water to the water outlet; and at least one hose segment selectively coupled to the water outlet, the at least one hose segment comprising at least one misting nozzle, wherein the at least one hose segment is configured to receive the pressurized flow of water via the water outlet and output a mist of water via the at least one misting nozzle.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein, the term "interface" refers to any shared boundary across which two or more separate components of a computer system may exchange information. The exchange can be between software, computer hardware, peripheral devices, humans, and combinations thereof. The term "interface" may be further defined as any shared boundary or connection between two dissimilar objects, devices or systems through which information or power is passed and/or a mechanical, functional and/or operational relationship is established and/or accomplished. Such shared boundary or connection may be physical, electrical, logical and/or combinations thereof.

An exemplary system, method, and apparatus according to the principles herein include a misting cooler apparatus and system comprising a battery, misting tubing with nozzles, hook and loop straps, and clips to mount the misting tubing. In accordance with certain aspects of the present disclosure, the misting nozzles can be attached to chairs, tents, umbrellas, trees and/or other outdoor structures. The misting cooler contains a water reservoir configured to supply water to the misting nozzles. The cooler can also be used to store ice and cold drinks.

In various embodiments, the misting cooler apparatus and system may include a user interface comprising an ON/OFF power button and a battery level gauge. The misting cooler apparatus and system may comprise a pressure adjustment screw operably engaged with the pump to enable a user to selectively adjust a pressure setting of the pump to increase or decrease the amount of mist at the misting nozzles. The misting cooler apparatus and system may comprise an automatic shutoff feature to prevent damage to the pump; for example, when the water reservoir is empty or pressure in the pump exceeds a specific threshold. In certain embodiments, the misting tubing with nozzles comprises a standard hose connector which can be connected to the misting cooler or a standard garden hose or spigot if use of the misting cooler is not desired.

In accordance with an exemplary use case provided by embodiments of the present disclosure, a user may prepare the misting cooler apparatus and system for use by adding a desired amount of water to the water reservoir. In certain use cases, ice can be added to the water if ice-cold mist is desired. The water reservoir may comprise a zipper closure to selectively open and seal the water reservoir. In certain embodiments, the misting cooler apparatus and system may comprise a removable battery. In said embodiments, the user may open the battery compartment door and insert the battery until it clicks into place, indicating it is fully latched. The user may securely close the battery compartment door prior to operation. To prepare the misting cooler apparatus and system for operation, the user may remove a water outlet cover from a water outlet disposed on an exterior surface of a base portion of the misting cooler apparatus and system and attach the hose connector of the misting tubing to the water outlet. The misting tubing may comprise at least one T-joint coupled to a terminal end of the misting tubing. The user may attach a misting nozzles to at least one outlet of the T-joint. The user may connect one or more additional segments of misting hose to the T-joints to extend the length of the misting hose. The user may attach one or more additional misting nozzles to the one or more additional segments. In certain embodiments, the misting cooler apparatus and system may comprise a user interface comprising a power button configured to turn the pump on and engage misting. The user interface may comprise a battery level indicator.

Certain benefits and advantages of the present disclosure include a portable misting cooler apparatus and system configured to enable a user to setup a misting system at any outdoor location, without the need for a dedicated water supply and/or dedicated power source.

Turning now descriptively to the drawings, in which similar reference characters denote similar elements throughout the several views, FIG. 1 depicts an isometric view of a portable misting cooler system 100. In accordance with certain aspects of the present disclosure, system 100 comprises a cooler portion 102, a base assembly 104 and a misting assembly 106. Cooler portion 102 may be configured as a bag-style cooler and may comprise a zipper closure 103 disposed on an upper surface. In certain embodiments, cooler portion 102 may comprise a soft-sided cooler with flexible side walls. In certain embodiments, cooler portion 102 may be configured as a hard-sided cooler with rigid side walls. In certain embodiments, cooler portion 102 may be thermally insulated. In certain embodiments, cooler portion 102 may comprise one or more handle 107 coupled to a side wall of cooler portion 102 and configured to enable a user to carry cooler system 100 by hand. In certain embodiments, cooler portion 102 may comprise a shoulder strap 105 removably coupled to one or more grommets or D-rings disposed on a side wall of cooler portion 102. In accordance with certain embodiments, shoulder strap 105 is configured to enable a user to carry portable misting cooler system 100 on the user's shoulder. Base assembly 104 may comprise an assembly comprising one or more water transfer tubes, a pump, a battery and an electronics assembly (as described more fully hereinbelow) configured to provide a pressurized flow of water from cooler portion 102 to misting assembly 106. Base assembly 104 may comprise a battery door 108 configured to selectively house the battery. Base assembly 104 may further comprise a user interface 110 comprising an ON/OFF button or switch configured to engage and disengage the pump. The user interface may further comprise one or more button inputs configured to command a controller to control one or more operations of the pump; for example, a pressure level for the pump. In certain embodiments, user interface 110 may comprise a battery level indicator configured to provide a visual indication (e.g., lights) of a charge level of the battery. In accordance with certain aspects of the present disclosure, base assembly 104 comprises a rigid housing configured to provide structural stability to portable misting cooler system 100 such that cooler portion 102 stands upright when portable misting cooler system 100 is placed on the ground. In accordance with certain embodiments, misting assembly 106 may comprise one or more length of tubing 122, a connector portion 126, one or more T-joint 124, at least one misting nozzle 125 coupled to an outlet of T-joint 124 and at least one T-joint end cap 109 coupled to a terminal end of at least one T-joint 124. In accordance with certain aspects of the present disclosure, misting assembly 106 is configured to receive a pressurized flow of water via tubing 122 and deliver a misting output via at least one misting nozzle 125.

Figure 2:
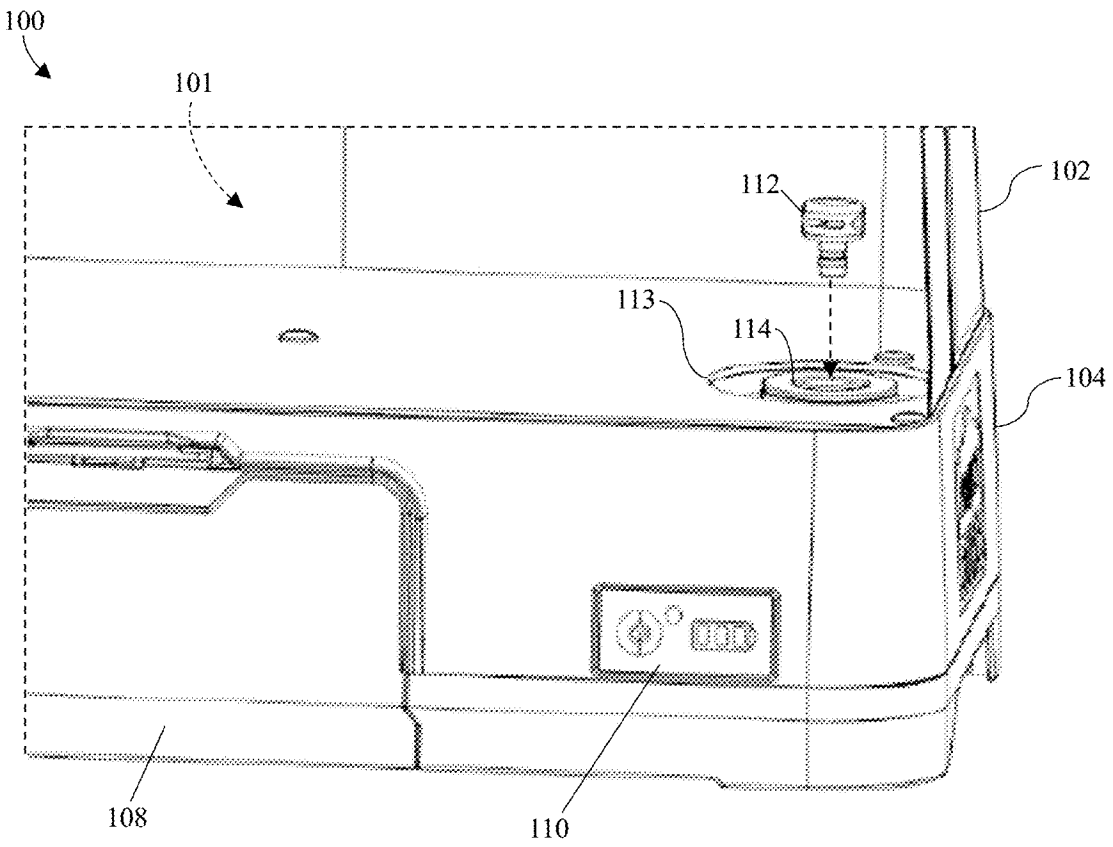
FIG. 2 is a cutaway view of a portable misting cooler apparatus and system, in accordance with certain aspects of the present disclosure.

Referring now to FIG. 2, a cutaway view of portable misting cooler system 100 is shown. As shown in FIG. 2, cooler portion 102 comprises an interior compartment 101 configured to hold and retain a volume of water, and optionally ice, therein. Cooler portion 102 may comprise an aperture 113 disposed on a bottom surface thereof. Aperture 113 may be aligned with a water inlet 114 disposed on base assembly 104 when cooler portion 102 is selectively coupled with base assembly 104. In certain embodiments, the bottom surface of cooler portion 102 may comprise a rigid structure configured to provide structural integrity to cooler portion 102 and promote a water-tight interface between aperture 113 and water inlet 114. In accordance with certain aspects of the present disclosure, water inlet 114 is configured to receive a flow of water from interior compartment 101 of cooler portion 102 via aperture 113. System 100 may further comprise a filter fitting 112 configured to be selectively interfaced with water inlet 114. Filter fitting 112 may comprise a water filter configured to filter out debris and particulates that might cause damage to the pump.

Figure 3:
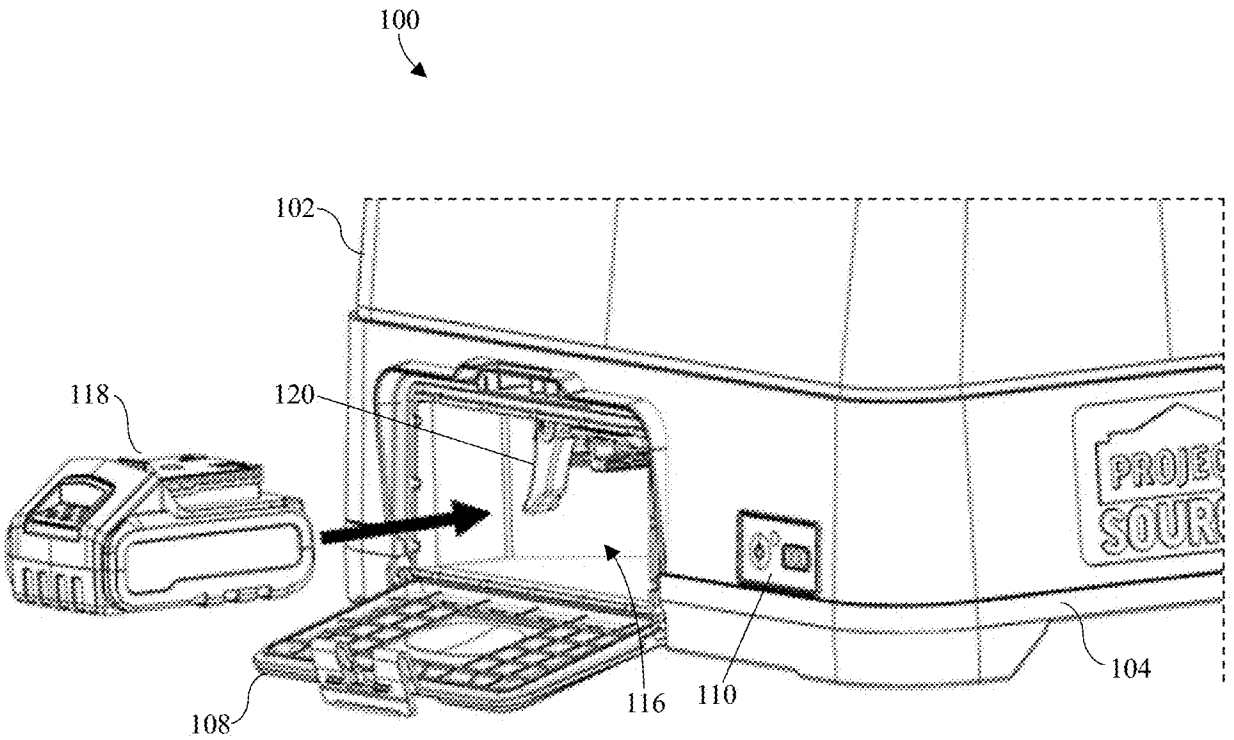
FIG. 3 is a cutaway view of the portable misting cooler apparatus and system, in accordance with certain aspects of the present disclosure.

Referring now to FIG. 3, a cutaway view of the portable misting cooler system 100 is shown. As shown in FIG. 3, base assembly 104 may comprise a battery compartment 116 comprising an interior area of base assembly 104. Battery door 108 may be configured to open and close via a hinge or other mechanical interface to selectively expose and cover battery compartment 116. System 100 may comprise a rechargeable battery 118 configured to be selectively interfaced with a battery terminal within battery compartment 116. In certain embodiments, system 100 may comprise a battery release mechanism 120 configured to disconnect battery 118 from a battery connector assembly within battery compartment 116. In certain embodiments, rechargeable battery 118 may be configured to interface with one or more additional battery-powered devices (e.g., drills, saws, lights, etc.). In certain embodiments, user interface 110 comprises an ON/OFF button configured to engage and disengage a load to battery 118. User interface 110 may comprise a battery level indicator configured to provide a visual indication of a charge level for battery 118.

Figure 4A:
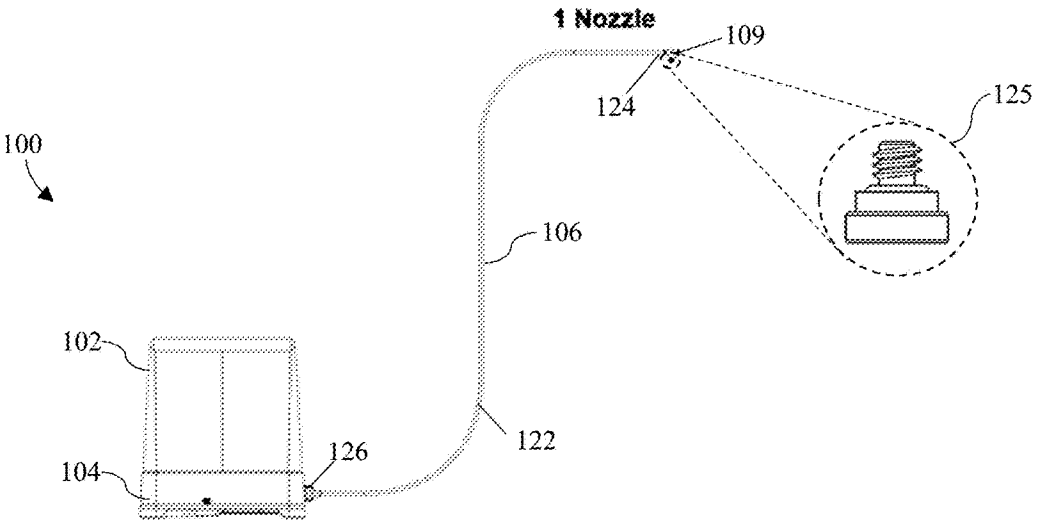
FIGS. 4A and 4B are plan views of the portable misting cooler apparatus and system, in accordance with certain aspects of the present disclosure.
Figure 4B:
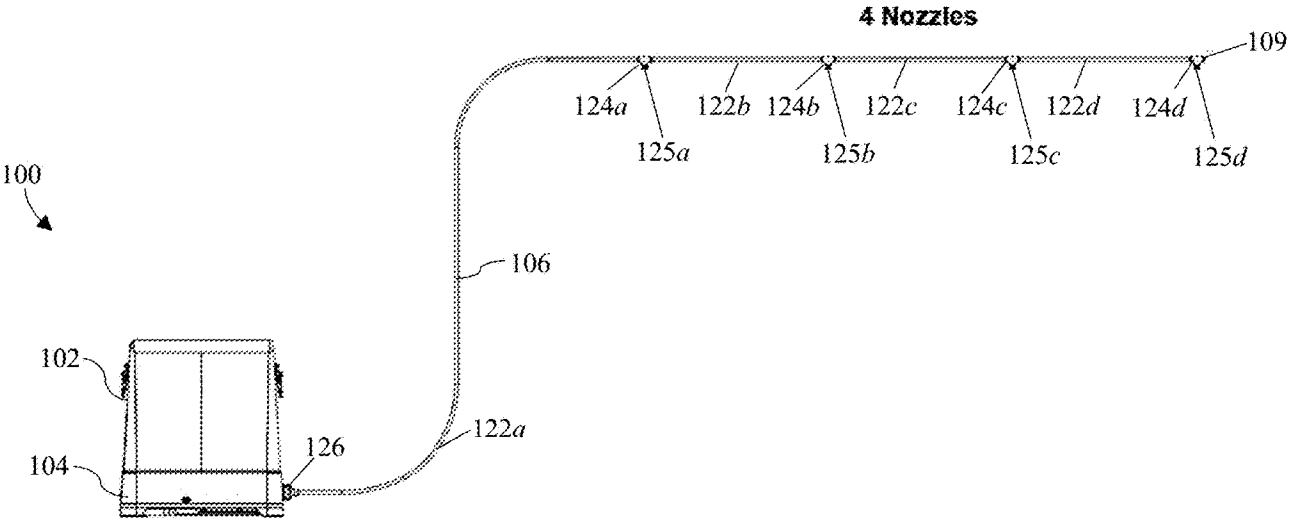

Referring now to FIGS. 4A and 4B, plan views of the portable misting cooler system 100 are shown. In accordance with certain aspects of the present disclosure, as shown in FIG. 4A, misting assembly 106 comprises a length of tubing 122 with a connector 126 attached to a first end of the length of tubing 122 and a T-joint 124 attached to a second end of tubing 122. Misting assembly 106 may further comprise a misting nozzle 125 selectively coupled to an outlet of T-joint 124. A T-joint end cap 109 may be coupled to a terminal end of at least one T-joint 124 to establish a water-tight seal. In accordance with certain aspects of the present disclosure, connector 126 is configured to be selectively coupled to a water outlet disposed on base assembly 104 to receive a pressurized flow of water via base assembly 104 and deliver a misting output via misting nozzle 125. In accordance with certain aspects of the present disclosure, as shown in FIG. 4B, misting assembly 106 may comprise a plurality of tubing segments 122*a-d*. Each tubing segment 122*a-d* may be coupled via a plurality of T-joints 124*a-d* to enable a user to increase the length of tubing and/or add additional misting nozzles 125*a-d*.

Figure 5:
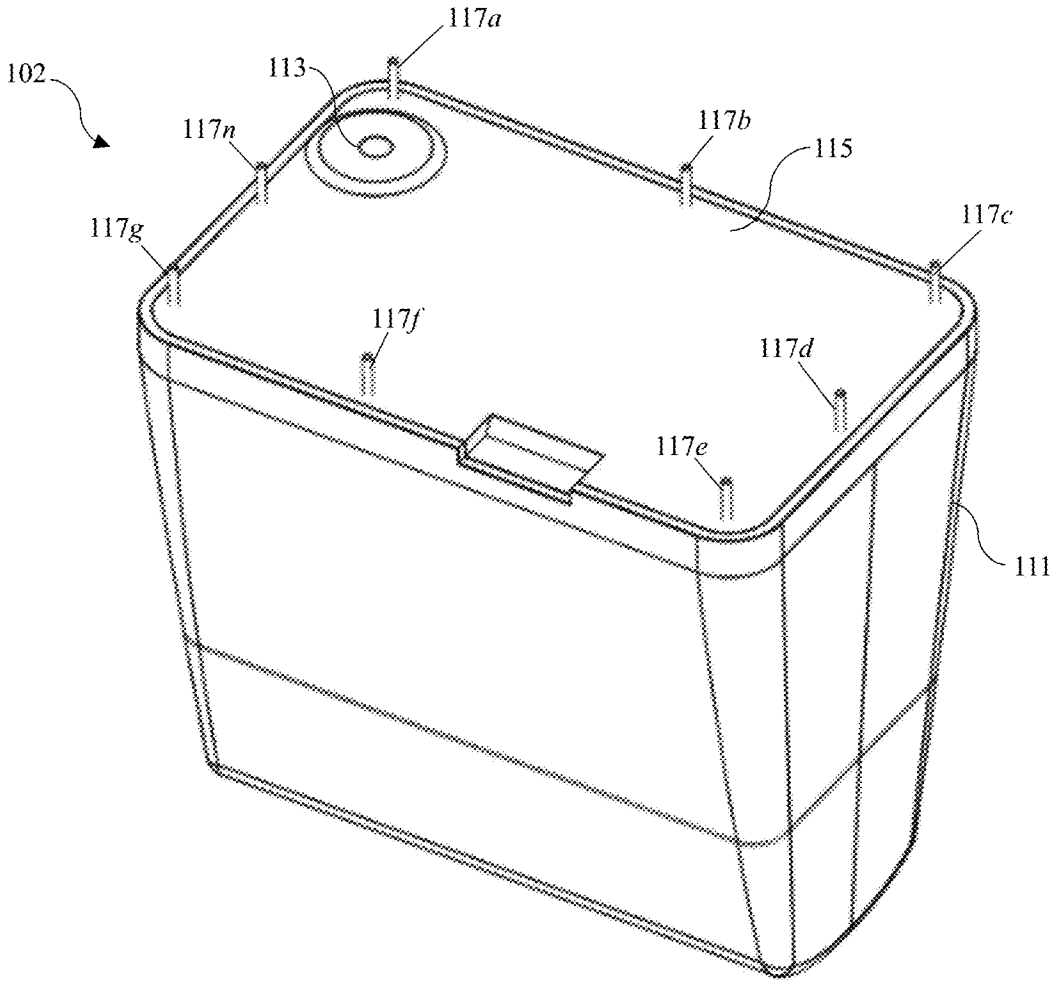
FIG. 5 is an isometric view of a cooler portion of the portable misting cooler apparatus and system, in accordance with certain aspects of the present disclosure.
Figure 6A:
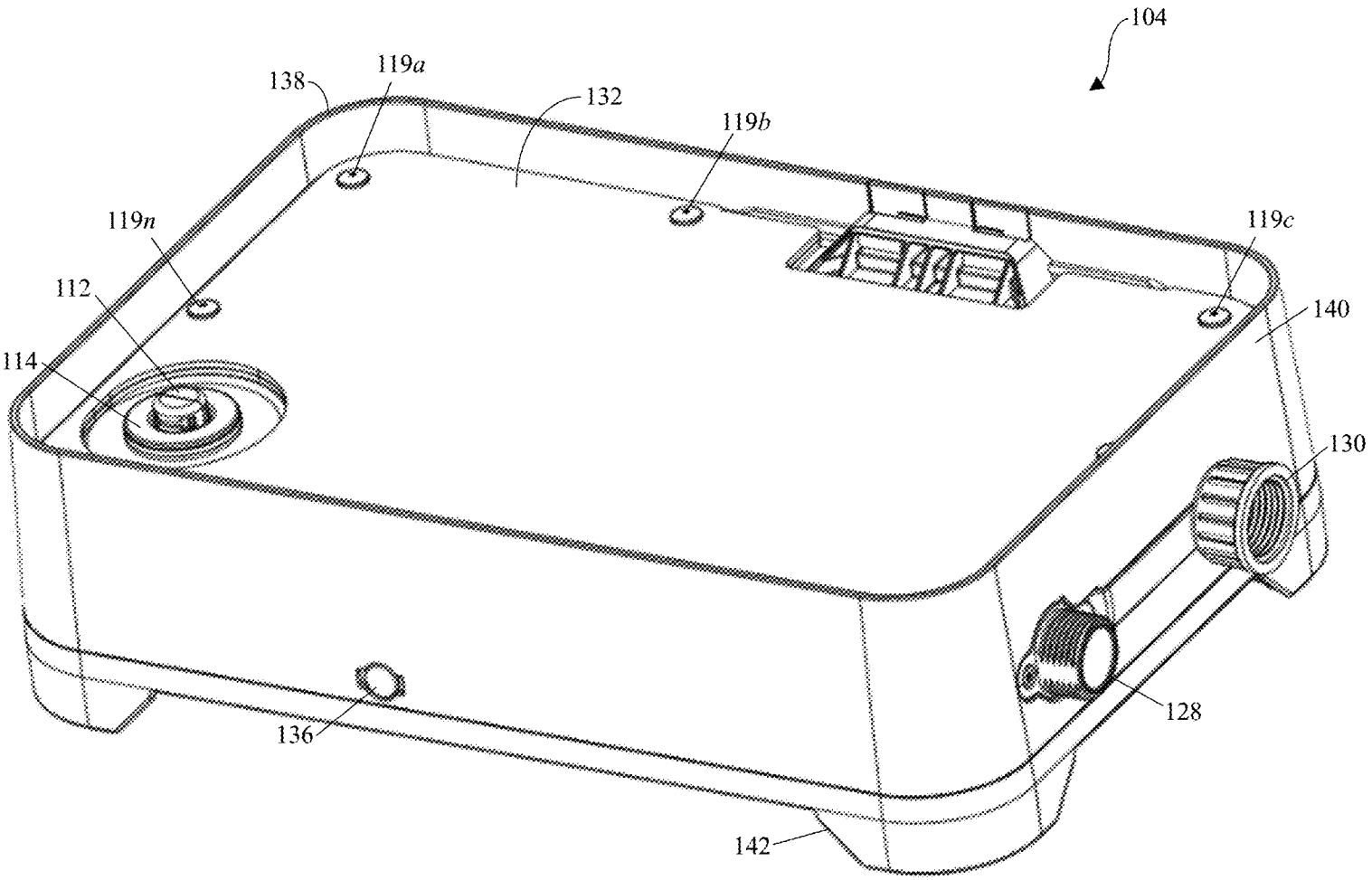
FIGS. 6A-6D are isometric views of a base assembly of the portable misting cooler apparatus and system, in accordance with certain aspects of the present disclosure.

Referring now to FIG. 5, an isometric view of cooler portion 102 of portable misting cooler system 100 (e.g., as shown in FIG. 1) is shown. As shown in FIG. 5, cooler portion 102 is shown in an inverted (i.e., upside-down) position to better illustrate the structure of the bottom surface of cooler portion 102. In accordance with certain aspects of the present disclosure, as described in further detail from FIGS. 1-2, cooler portion 102 comprises side-walls 111 configured to define an internal volume of cooler portion 102. Side walls 111 may comprise a thermal insulation and/or may be constructed from a thermally insulating material configured to thermally insulate the interior area of cooler portion 102. Cooler portion 102 may comprise a rigid bottom surface 115 configured to provide structural support and stability for cooler portion 102 and enable cooler portion 102 to stand upright when interfaced with base assembly 104 (shown in FIG. 1). Rigid bottom surface 115 may be selectively interfaced with an upper surface 132 (shown in FIG. 6A) of base assembly 104 (e.g., as shown in FIG. 6A). Cooler portion 102 may comprise an aperture 113 configured to interface with water inlet 114 (e.g., as shown in FIG. 6A) to receive an upper portion of filter fitting 112 (e.g., as shown in FIG. 6A) therethrough. Rigid bottom surface 115 may comprise a raised area around aperture 113 to improve/enhance a water-tight interface between aperture 113 and water inlet 114 (e.g., as shown in FIG. 6A). In accordance with certain aspects of the present disclosure, cooler portion 102 may comprise a plurality of protrusions 117*a-n* extending from the surface of rigid bottom surface 115. In accordance with certain embodiments, plurality of protrusions 117*a-n* are configured to interface with a plurality of connector apertures 119*a-n* (shown in FIGS. 6A-6D). In certain embodiments, plurality of protrusions 117*a-n* and/or plurality of connector apertures 119*a-n* may comprise one or more mechanical components configured to enable a press-fit interface between rigid bottom surface 115 and base assembly 104 (e.g., as shown in FIG. 1).

Figure 6B:
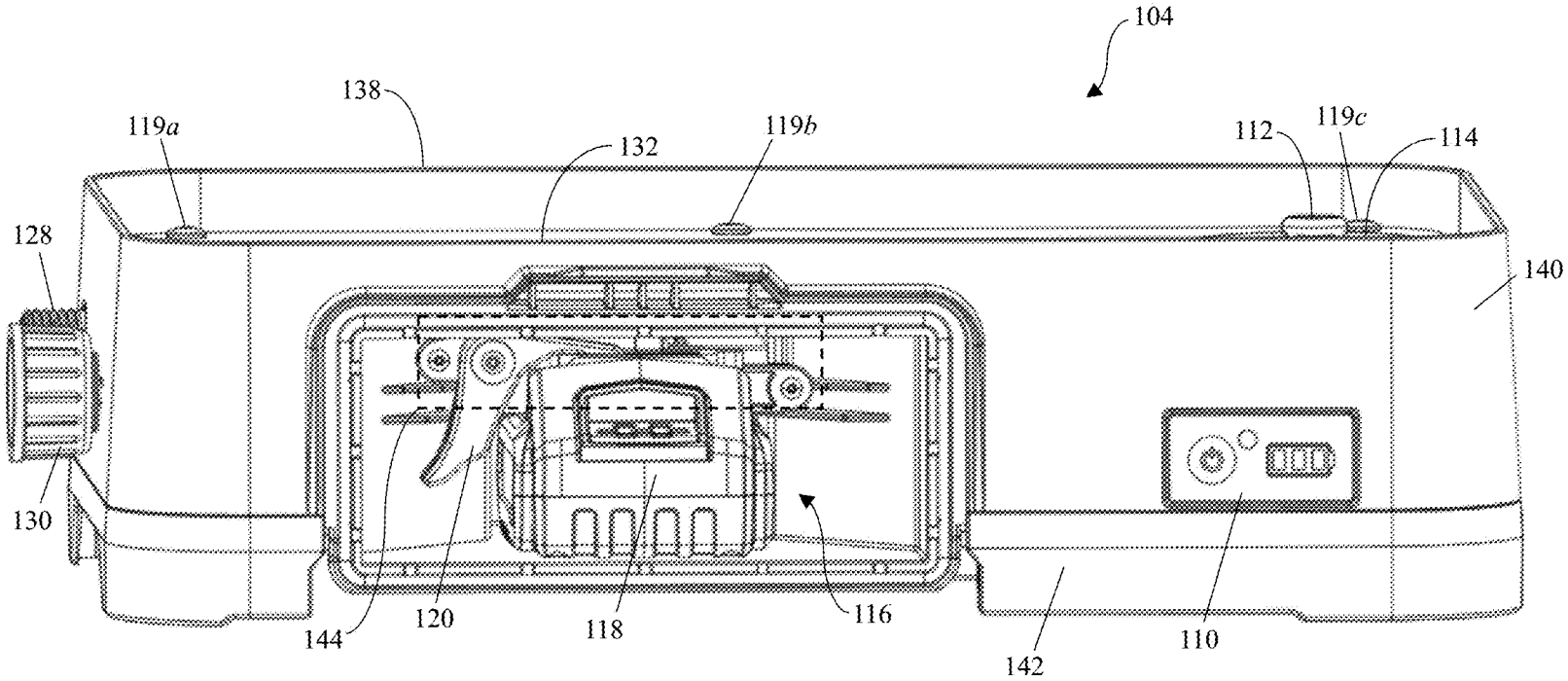
Figure 6C:
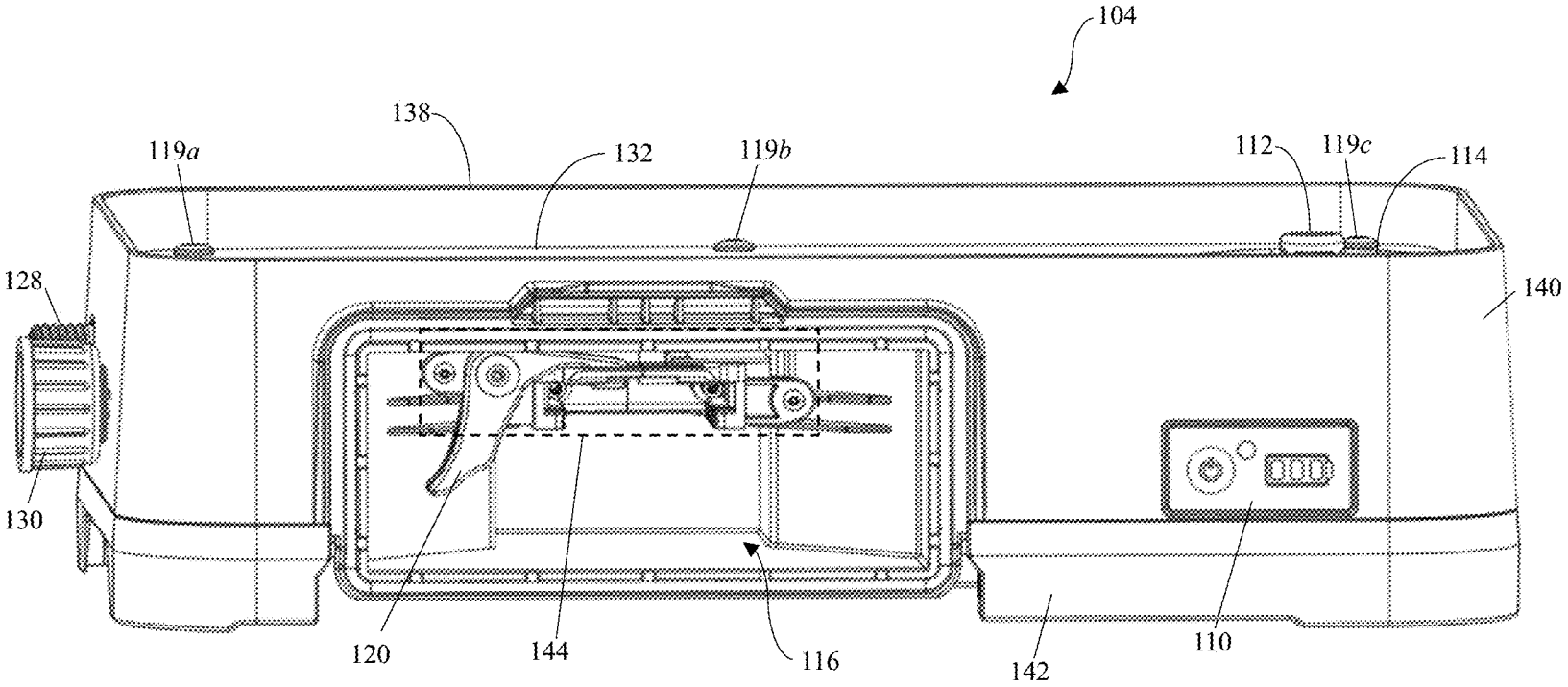
Figure 6D:
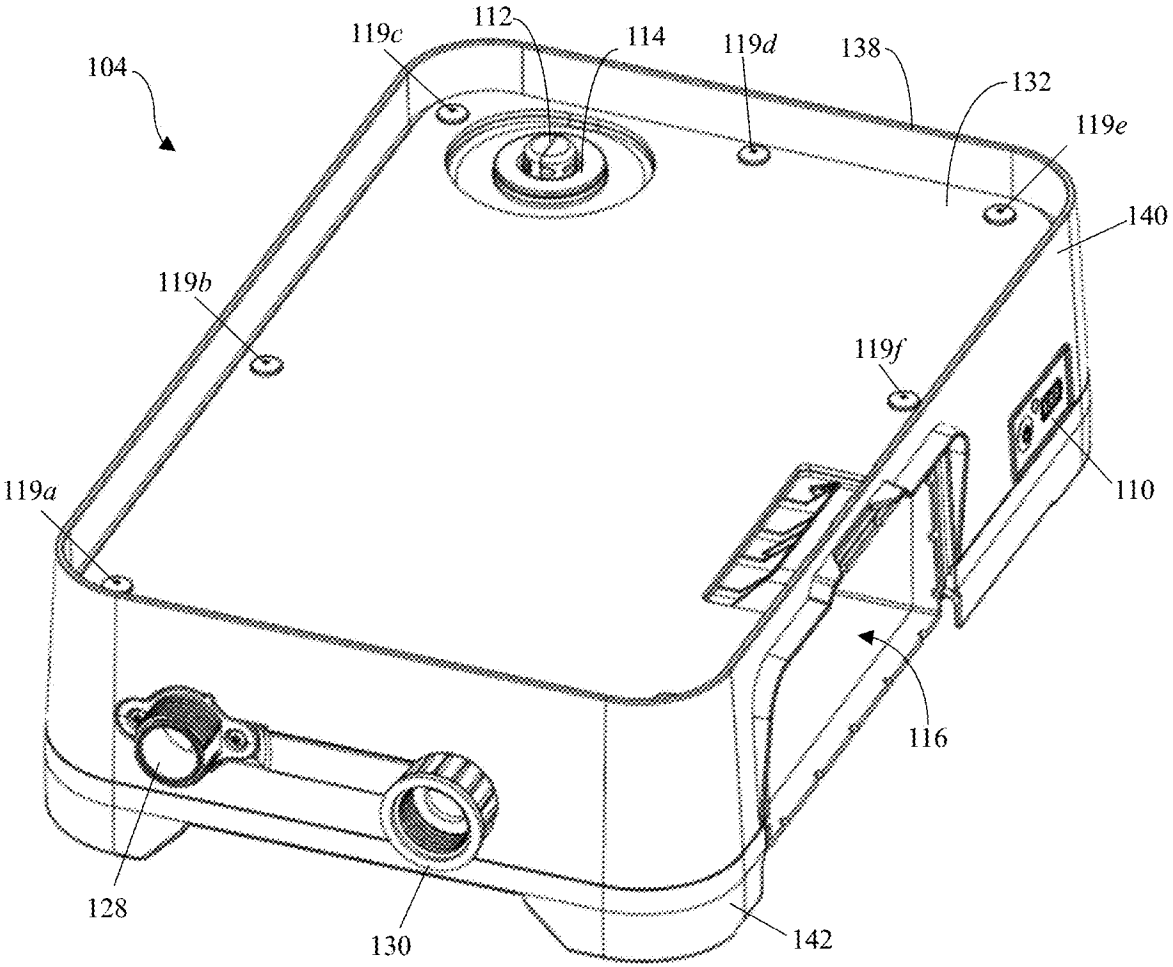
Figure 7:
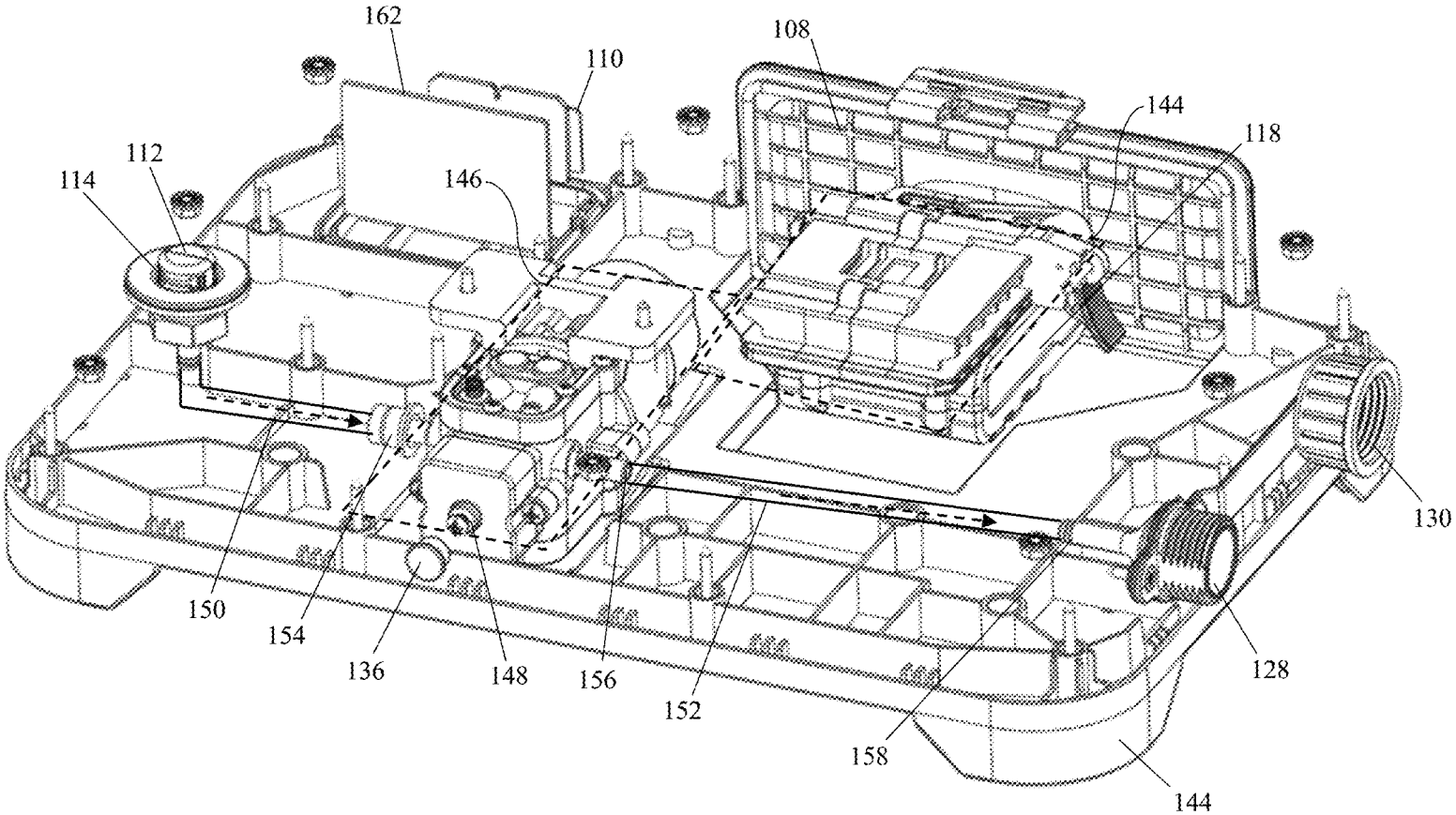
FIG. 7 is a schematic diagram of a component assembly of the portable misting cooler apparatus and system, in accordance with certain aspects of the present disclosure.

Referring now to FIGS. 6A-6D, isometric views of base assembly 104 of portable misting cooler system 100 (e.g., as shown in FIG. 1) are shown. In accordance with certain aspects of the present disclosure, base assembly 104 comprises an upper housing portion 140, a lower housing portion 142 and an upper surface 132. Upper housing portion 140 may define exterior side walls of base assembly 104. Lower housing portion 142 may be configured to provide stability for base assembly 104. Upper surface 132 may be oriented inside an upper perimeter 138 of upper housing portion 140. In accordance with certain aspects of the present disclosure, upper surface 132 is configured to provide a support surface for rigid bottom surface 115 of cooler portion 102 (e.g., as shown in FIG. 5). Upper surface 132 may comprise the plurality of connector apertures 119*a-n*. As discussed above, plurality of connector apertures 119*a-n* may be configured to receive the plurality of protrusions 117*a-n* (as shown in FIG. 5) to enable a secure interface between base assembly 104 and cooler portion 102 (e.g., as shown in FIG. 1). In certain embodiments, upper perimeter 138 is configured to retain a lower perimeter of cooler portion 102 (e.g., as shown in FIG. 5). Water inlet 114 and filter fitting 112 may be positioned at a corner of base assembly 104 and may extend through an opening of upper surface 132. Upper housing portion 140 may comprise a pressure adjustment screw cover 136 configured to selectively cover a pressure adjustment screw (as shown in FIG. 7). Base assembly 104 may comprise a water outlet 128 and a water outlet cap 130. Water outlet cap 130 may be configured to be selectively secured to a threaded portion of water outlet 128 to establish a water-tight seal at water outlet 128. Water outlet 128 may comprise a threaded neck to enable a threaded interface with water outlet cap 130 and connector portion 126 (e.g., as shown in FIG. 1). As shown in FIGS. 6B-6C, base assembly 104 may comprise a battery compartment 116 configured to receive and house battery 118. Battery compartment 116 may comprise a battery connector assembly 144 configured to receive and secure battery 118 and establish a power transfer interface with battery 118. Battery connector assembly 144 may comprise a battery release mechanism 120 configured to disconnect battery 118 from battery connector assembly 144.

Referring now to FIG. 7, a schematic diagram of a component assembly of portable misting cooler system 100 (e.g., as shown in FIG. 1) is shown. In accordance with certain aspects of the present disclosure, FIG. 7 illustrates the internal components of base assembly 104 (e.g., as shown in FIGS. 6A-6D). In accordance with certain aspects of the present disclosure, battery connector assembly 144 is configured to selectively receive/retain battery 118. Battery door 108 is configured to selectively conceal battery 118. In certain embodiments, portable misting cooler system 100 comprises a pump 146. Pump 146 may comprise a fluid transfer pump and may be configured to generate a pressurized output of water. A pressure adjustment screw 148 may enable a user to selectively adjust the output pressure for pump 146. Pressure adjustment screw cap 136 may be configured to conceal pressure adjustment screw 148 at upper housing portion 140 (e.g., as shown in FIG. 6A). System 100 may comprise a first water transfer tube 150 coupled to water inlet 114 at a first end and a pump inlet 154 at a second end. First water transfer tube 150 is configured to provide a flow of water between water inlet 114 and pump 146. System 100 may comprise a second water transfer tube 152 coupled to a pump outlet 156 at a first end and a stem 158 of water outlet 128 at a second end. Second water transfer tube 152 is configured to provide a pressurized flow of water from pump 146 to water outlet 128. Misting assembly 106 (e.g., as shown in FIGS. 4A-4B) may be coupled to water outlet 128 via connector 126 (e.g., as shown in FIGS. 4A-4B) to receive a pressurized flow of water at tubing 122 (e.g., as shown in FIGS. 4A-4B) and deliver a misting output at misting nozzle 125 (e.g., as shown in FIGS. 4A-4B). In accordance with certain aspects of the present disclosure, portable misting cooler system 100 may comprise a controller 162 operable engaged with user interface 110. Controller 162 may be operably configured to control a flow of power between battery 118 and pump 146 in response to a user-input at user interface 110. In certain embodiments, controller 162 may be configured to command one or more operational modes of pump 146 in response to a user-input at user interface 110 (e.g., increase or decrease an output pressure of pump 146).

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof. As used herein, "exemplary" means serving as an example or illustration and does not necessarily denote ideal or best.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. A portable misting system comprising:

an insulated cooler portion configured to retain a volume of water, the insulated cooler portion comprising an aperture disposed on a bottom surface of the insulated cooler portion and configured to receive a flow of water therethrough, wherein the insulated cooler portion comprises a bag-style cooler having flexible thermally insulated side walls and a rigid bottom surface, wherein the aperture is disposed through the rigid bottom surface;

a base assembly comprising an upper surface configured to interface with the bottom surface of the insulated cooler portion, wherein the base assembly comprises a water inlet configured to interface with the aperture of the insulated cooler portion to receive the flow of water therethrough;

a pump housed in an interior portion of the base assembly, wherein the water inlet comprises a filter fitting configured to filter debris or particulates from the flow of water before the flow of water is received by the pump, wherein the rigid bottom surface comprises a plurality of protrusions configured to be received by a plurality of connector apertures of the base assembly to secure the insulated cooler portion to the base assembly, wherein the base assembly comprises an upper perimeter configured to retain a lower perimeter of the insulated cooler portion;

a first water line configured to transfer the flow of water from the water inlet to the pump;

a second water line configured to transfer the flow of water from the pump to a water outlet disposed on an exterior surface of the base assembly; and a rechargeable battery selectively received within a battery compartment of the base assembly and configured to provide a flow of power to the pump.

2. The portable misting system of claim 1 further comprising a first hose segment selectively coupled to the water outlet and configured to receive the flow of water via the water outlet.

3. The portable misting system of claim 2 further comprising at least one first misting nozzle coupled to a portion of the first hose segment, the at least one first misting nozzle configured to output a mist of water.

4. The portable misting system of claim 1 wherein the rechargeable battery is selectively removable from the battery compartment via a battery release mechanism.

5. The portable misting system of claim 3 further comprising a second hose segment selectively coupled to the first hose segment, wherein the second hose segment is configured to receive the flow of water via the first hose segment.

6. The portable misting system of claim 5 further comprising at least one second misting nozzle coupled to a portion of the second hose segment, the at least one second misting nozzle configured to output the mist of water.

7. The portable misting system of claim 1 wherein the insulated cooler portion is configured to be selectively removable from the base assembly.

8. The portable misting system of claim 1 further comprising a controller operably engaged with the pump, wherein the controller is configured to control at least one operation of the pump.

9. A portable misting apparatus comprising:

an insulated cooler portion comprising a bottom surface, side walls, and a top configured to define an internal area, the internal area being configured to retain a volume of water therein, wherein the insulated cooler portion comprises a bag-style cooler having flexible thermally insulated side walls and a rigid bottom surface, wherein the bottom surface of the insulated cooler portion comprises an aperture configured to receive a flow of water therethrough, wherein the aperture is disposed through the rigid bottom surface; and a base assembly comprising a rigid housing, the rigid housing comprising an upper surface and an interior area, wherein the base assembly comprises a water inlet disposed on the upper surface of the rigid housing and a water outlet disposed on a first surface of the rigid housing, wherein the bottom surface of the insulated cooler portion is interfaced with the upper surface of the rigid housing such that the water inlet is interfaced with the aperture of the insulated cooler portion to receive the flow of water therethrough, wherein the base assembly comprises a pump housed in the interior area of the rigid housing, wherein the pump is operably configured to receive the flow of water from the water inlet and output a pressurized flow of water to the water outlet, wherein the water inlet comprises a filter fitting configured to filter debris or particulates from the flow of water before the flow of water is received by the pump, wherein the rigid bottom surface comprises a plurality of protrusions configured to be received by a plurality of connector apertures disposed on the upper surface of the rigid housing to secure the insulated cooler portion to the base assembly, wherein the rigid housing comprises an upper perimeter configured to retain a lower perimeter of the insulated cooler portion, and wherein the base assembly comprises a rechargeable battery selectively received within a battery compartment of the rigid housing and configured to provide a flow of power to the pump.

10. The portable misting apparatus of claim 9 wherein the water outlet is configured to be selectively interfaced with at least one misting hose.

11. The portable misting apparatus of claim 9 wherein the insulated cooler portion is configured to be selectively removable from the base assembly.

12. The portable misting apparatus of claim 9 wherein the rechargeable battery is selectively removable from the battery compartment via a battery release mechanism.

13. The portable misting apparatus of claim 9 further comprising a controller operably engaged with the pump, wherein the controller is configured to control at least one operation of the pump.

14. The portable misting apparatus of claim 13 further comprising a user interface disposed on a second surface of the rigid housing, wherein the user interface is operably engaged with the controller and configured to command one or more operations of the controller in response to a user input.

15. A portable misting system comprising:

an insulated cooler portion comprising an interior area configured to retain a volume of water therein, a bottom surface, and an aperture disposed on the bottom surface configured to pass a flow of water therethrough, wherein the insulated cooler portion comprises a bag-style cooler having flexible thermally insulated side walls and a rigid bottom surface, wherein the aperture is disposed through the rigid bottom surface;

a base assembly comprising a rigid housing comprising an upper surface, a water inlet disposed on the upper surface of the rigid housing, a pump housed in an internal area of the rigid housing, and a water outlet disposed on a surface of the rigid housing, wherein the water inlet comprises a filter fitting configured to filter debris or particulates from the flow of water before the flow of water is received by the pump, wherein the bottom surface of the insulated cooler portion is interfaced with the upper surface of the rigid housing such that the aperture disposed on the bottom surface is interfaced with the water inlet to pass the flow of water therethrough, wherein the rigid bottom surface comprises a plurality of protrusions configured to be received by a plurality of connector apertures disposed on the upper surface of the rigid housing to secure the insulated cooler portion to the base assembly, wherein the rigid housing comprises an upper perimeter configured to retain a lower perimeter of the insulated cooler portion, wherein the pump is operably configured to receive the flow of water from the water inlet and output a pressurized flow of water to the water outlet; and at least one hose segment selectively coupled to the water outlet, the at least one hose segment comprising at least one misting nozzle, wherein the at least one hose segment is configured to receive the pressurized flow of water via the water outlet and output a mist of water via the at least one misting nozzle, and a rechargeable battery selectively received within a battery compartment of the rigid housing and configured to provide a flow of power to the pump.

16. The portable misting system of claim 15 wherein the rechargeable battery is configured to interface with one or more additional battery-powered devices.

17. The portable misting system of claim 15 further comprising a controller operably engaged with the pump, wherein the controller is configured to control at least one operation of the pump.

18. The portable misting system of claim 17 further comprising a user interface operably engaged with the controller and configured to command one or more operations of the controller in response to a user input.

19. The portable misting system of claim 16 wherein the rechargeable battery is selectively removable from the battery compartment via a battery release mechanism.

20. The portable misting system of claim 15 wherein the base assembly is configured to provide structural support for the insulated cooler portion.

* * * * *